United States Patent [19]

Okumura

[11] 4,451,135

[45] May 29, 1984

[54] TONER CONCENTRATION DETECTING DEVICE

[75] Inventor: Masanobu Okumura, Tokyo, Japan

[73] Assignee: Olympus Optical Company Limited, Tokyo, Japan

[21] Appl. No.: 486,019

[22] Filed: Apr. 18, 1983

[30] Foreign Application Priority Data

Apr. 20, 1982 [JP] Japan ..... 57-57266[U]

[51] Int. Cl.[3] ..... G03G 15/06

[52] U.S. Cl. ..... 355/3 DD; 118/691

[58] Field of Search ..... 355/3 DD, 14 D, 3 R; 118/689–691, 653–658

[56] References Cited

U.S. PATENT DOCUMENTS 3,727,065 4/1973 Maksymiak ..... 355/3 DD
4,226,525 10/1980 Sakamoto et al. ..... 355/3 DD
4,265,997 5/1981 Extra et al. ..... 118/691 X
4,273,843 6/1981 Fujita et al. ..... 355/3 DD X
4,371,257 2/1983 Nishikawa ..... 355/14 D

*Primary Examiner*—R. L. Moses
*Attorney, Agent, or Firm*—Fleit, Jacobson, Cohn & Price

[57] ABSTRACT

A toner concentration detecting device for detecting the toner concentration of a dry-type, two-component developer including a transparent plate arranged to be brought into contact with the developer, a light source for projecting light toward the developer through the transparent plate, and a light receiving element for receiving light scattered by the developer through the transparent plate. The transparent plate is separated optically by cutting it along a plane bisecting the light source and the light receiving element. In such a construction, multiple reflection inside the transparent plate which affects the resulting measurement can be completely eliminated, and thus it is possible to detect the toner concentration in an accurate and uniform manner.

8 Claims, 10 Drawing Figures

TONER CONCENTRATION DETECTING DEVICE

BACKGROUND OF THE INVENTION

The present invention relates to a toner concentration detecting device for detecting the toner concentration of a dry-type, two-component magnetic developer by projecting a light flux onto the developer and detecting the light intensity reflected by the developer.

In a known developing device using a dry-type two-component developer (a mixture of carriers and toners), since only the toner in the developer is consumed during a developing operation, the toner concentration and thus the copying concentration are decreased corresponding to an increase the number of copies. Therefore, up to the present, various methods for automatically supplying the toner by detecting the toner concentration have been proposed. One of the most effective and easy methods is to control the toner concentration in response to the magnitude of an output signal generated by detecting the reflected light intensity from the developer.

FIGS. 1A and 1B are enlarged cross-sectional views showing a known toner concentration detecting device. As shown in FIG. 1A, a light flux emitted from a light source 1 arranged in a housing 6 is projected through a transparent electrode 3 onto the developer in a developing device. Then, a part of the scattered light flux is made incident upon a light receiving element 2 arranged in the housing 6 through the transparent electrode 3, and is photoelectrically converted into an output voltage corresponding to the incident light flux. The transparent electrode 3 includes a transparent plate 3*a* made of, for example, glass and a transparent conductive layer 3*b*. In such a construction, a suitable bias potential, such as a ground potential, is applied to the transparent conductive layer 3*b*. As for the light source 1, use may be made of a tungsten lamp, an LED, etc. and as for the light receiving element 2, a phototransistor, a photodiode, etc. may be used. The output voltage of the light receiving element 2 is supplied to a comparator through an amplifier and a filter, and is compared with a predetermined standard voltage. If the output voltage is higher than the standard voltage, the toner concentration is judged to be lower than a predetermined toner concentration, and thus toner is supplied to the developing device correspondingly. In an ideal state, the output voltage is assumed to vary in response to a variation of the toner concentration as shown by the graph in FIG. 2. Now it is assumed that the standard voltage Vc in FIG. 2 corresponds to the predetermined toner concentration of 7%. When the output voltage is higher than Vc, toner is always supplied to the developing device so that the toner concentration is maintained near 7% during the copying operation.

However, when the relation between the toner concentration and the output voltage is actually measured by using the aforementioned toner concentration detecting device, in the high toner concentration range the output voltage has a certain finite value Vo as shown in FIG. 3 and never goes below the finite value Vo. Moreover, even if the device is placed in a black space, the output voltage does not go below the finite value Vo. In such a case the toner concentration detecting sensitivity becomes lower than the case shown in FIG. 2. Therefore, various noise sources affect the measuring result, and thus toner concentration detection and control cannot be performed precisely. After various experiments were performed, it was confirmed that such an undesired phenomenon is mainly due to a multiple reflection inside the transparent electrode 3 as shown in FIG. 1B. In this case the amount of the multiply reflected light flux is very little, but since the amount of the scattered light flux from the developer is also very little, the multiple reflection mentioned above has a large effect on the measurement. Therefore, in order to increase the relative sensitivity of the toner concentration detection and to detect the toner concentration accurately, the multiply reflected light flux must be removed completely.

SUMMARY OF THE INVENTION

The present invention has for its object to eliminate the drawbacks mentioned above and to provide a toner concentration detecting device which can increase the relative sensitivity of toner concentration detection by removing completely a multiply reflected light flux and can perform a stable toner concentration control.

According to the invention, in a toner concentration detecting device for detecting the toner concentration of a dry-type, two-component developer comprising transparent plate-like means provided on a housing, means provided in said housing for projecting light toward the developer through the transparent plate-like means, and means provided in said housing for receiving light scattered by the developer through the transparent plate-like means to produce a photoelectrically converted signal representing the toner concentration of the developer, the improvement comprises means for optically separating a portion of said transparent plate-like means opposite to said light projecting means and a portion of said transparent plate-like means opposite to said light receiving means to eliminate the multiple reflection inside said transparent plate-like means.

DESCRIPTION OF THE PREFERRED EMBODIMENTS

Figure 1A:
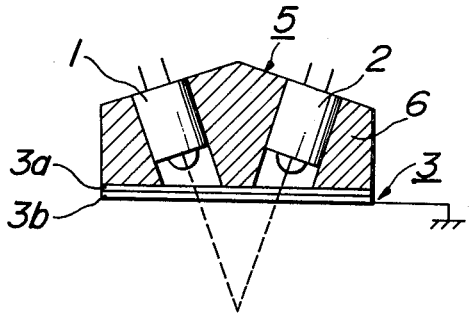
FIG. 1A PRIOR ART
FIGS. 1A and 1B are enlarged cross-sectional views showing a known toner concentration detecting device.
Figure 1B:
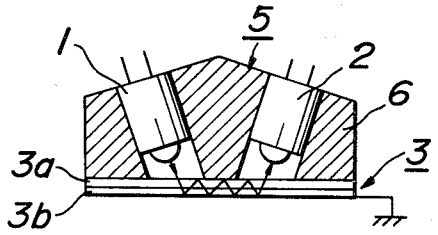
FIG. 1B PRIOR ART
Figure 2:
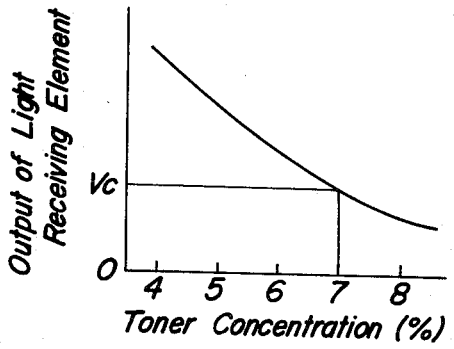
FIG. 2 PRIOR ART
FIG. 2 is a graph illustrating the ideal relation between toner concentration and the output of a light receiving element.
Figure 3:
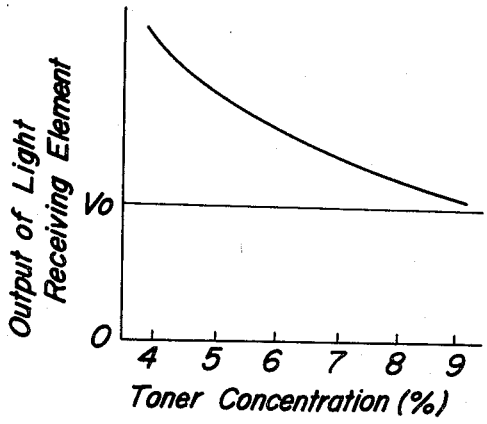
FIG. 3 PRIOR ART
FIG. 3 is a graph depicting the relation between the toner concentration and the output in the case of using the known toner concentration detecting device.
Figure 4:
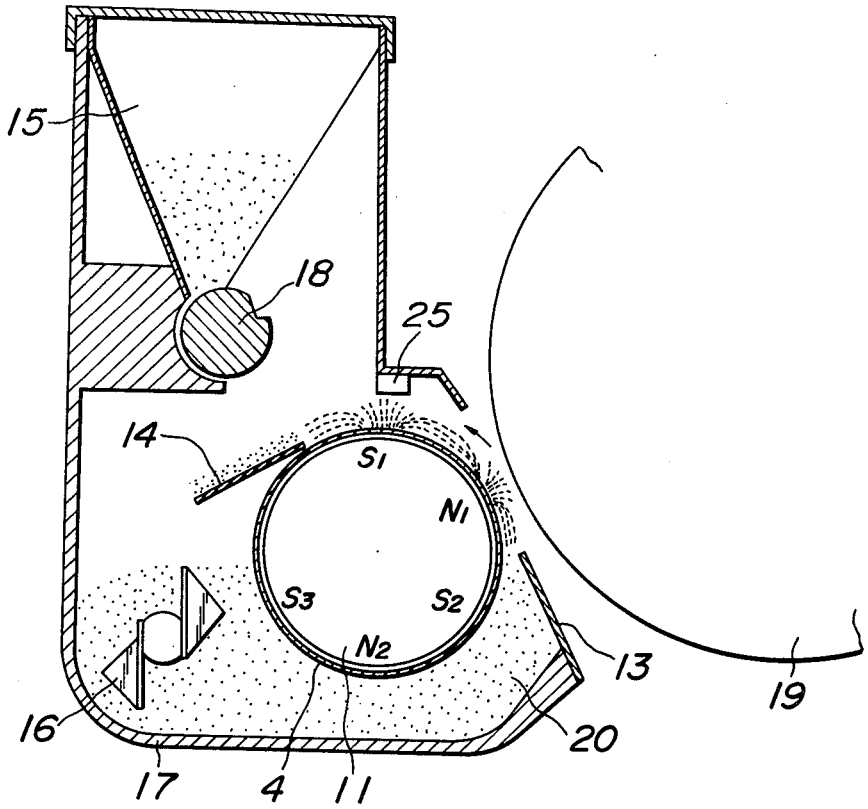
FIGS. 4 and 5 are schematic views respectively showing one embodiment of a developing device which can preferably use the toner concentration detecting device according to the invention.

FIG. 4 is a schematic view showing one embodiment of a developing device which can preferably use a toner concentration detecting device according to the invention. In FIG. 4, a developer 20 contained in a developer vessel 17 is transferred in the direction of the arrow together with the rotation of a non-magnetic sleeve 4 while being adhered to the non-magnetic sleeve 4 by means of the magnetic force of a magnet roll 11, and then the thickness of the developer is uniformly regulated by a doctor blade 13. After that, the thus regulated developer is brought into contact with a photosensitive drum 19 so as to develop an electrostatic latent image formed on the photosensitive drum 19. Then, after the developing operation the developer is removed from the non-magnetic sleeve 4 by means of a scraper 14 and falls down into an agitation member 16 to be agitated and transferred. The transferred developer is again adhered to the non-magnetic sleeve 4 by magnetic force to prepare the next developing operation. In this embodiment, a toner concentration detecting device 25 is arranged at such a position that a transparent electrode thereof is brought into contact with an ear-up portion of the developer. Under the control of the toner concentration detecting device 25, the toner is supplied from a toner hopper 15 by rotating a toner supply roller 18. The supplied toner is agitated and mixed with the developer removed from the non-magnetic sleeve 4 so as to uniformly maintain the toner concentration.

Figure 5:
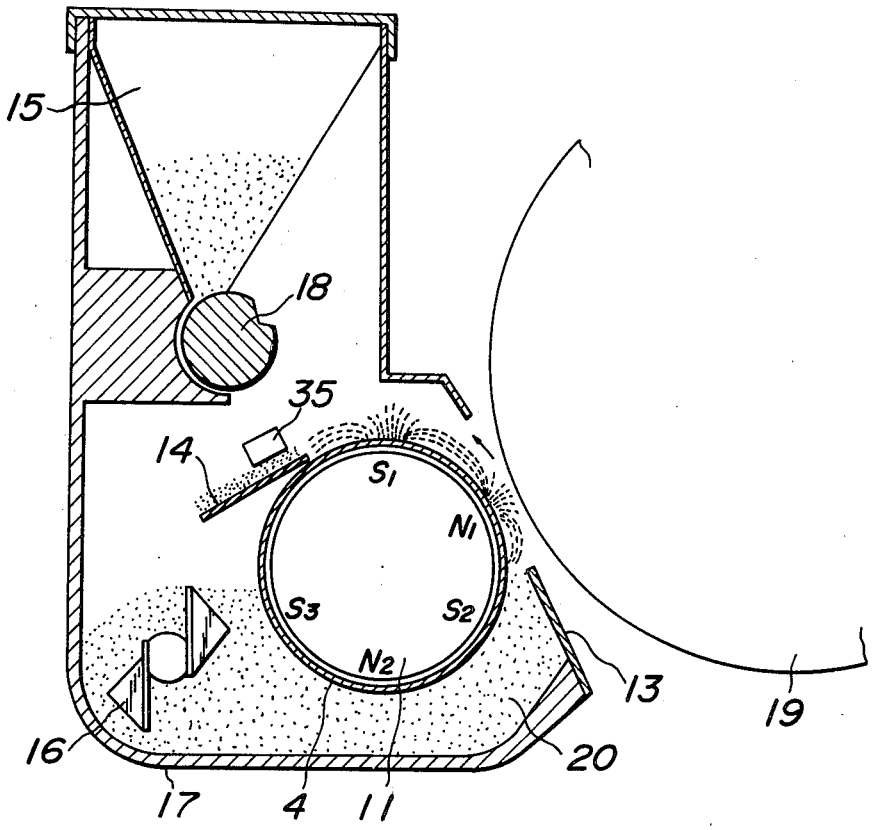

FIG. 5 is a schematic view showing another embodiment of the developing device which can preferably use a toner concentration detecting device according to the invention. The difference between the embodiments shown in FIGS. 4 and 5 is that a toner concentration detecting device 35 is arranged at a position opposed to the scraper 14 and not at the position opposed to the ear-up portion. Elements in FIG. 5 similar to those shown in FIG. 4 are denoted by the same reference numerals used in FIG. 4 and the explanation thereof is omitted here. In this embodiment, as in the embodiment shown in FIG. 4, the toner concentration can be detected precisely.

Figure 6:
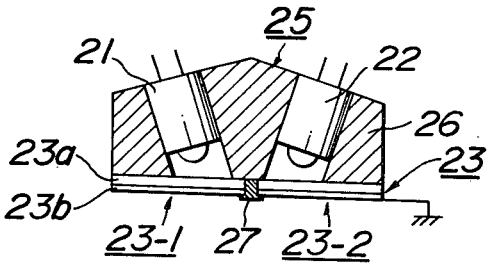
FIGS. 6 and 7 are schematic views respectively illustrating embodiments of a toner concentration detecting device according to the invention.
Figure 8:
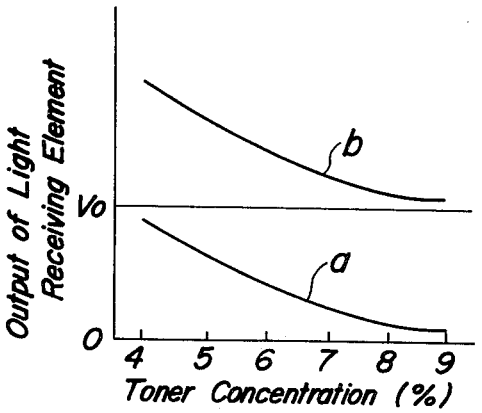
FIG. 8 is a graph depicting the relation between the toner concentration and the output in the case of using the toner concentration detecting device according to the invention.

FIG. 6 is a schematic view showing one embodiment of the toner concentration detecting device 25 shown in FIG. 4. In this embodiment, a transparent electrode 23 consisting of a transparent plate 23*a* and a transparent conductive layer 23*b* is cut off at a center portion between portions 23-1 and 23-2 which are opposite a light source 21 and a light receiving element 22, respectively, as shown in FIG. 6 and the gap at the center portion is filled with an opaque conductive adhesive such as DOTITE (commercial name; made by Fujikura Kasei, Co., Ltd.). In such a construction, the light flux emitted from the light source 21 arranged in a housing 26 made of opaque material is projected through the transparent electrode portion 23-1 toward the developer in a developing device. Then, a part of the scattered light flux is made incident upon the light receiving element 22 arranged in the housing 26 by passing through the transparent electrode portion 23-2, and is photoelectrically converted into an output voltage corresponding to the intensity of incident light flux. Therefore, multiple reflection inside the transparent electrode can be blocked completely, so that the relation between the toner concentration and the output voltage illustrated by curve a in FIG. 8 is obtained and thus it is possible to make the relative sensitivity higher as compared with curve b in FIG. 8, which shows the conventional output voltage. As shown in FIG. 8, the curve a is lower than the curve b and the respective slopes thereof are the same. Since the maximum signal amplitude which can be processed by a circuit arranged after the light receiving element is limited, it is possible to make the amplifying gain of the the circuit according to the invention larger as compared with that according to the conventional device. Therefore, according to the invention, the sensitivity, which is defined by the ratio between the toner concentration and the output of the light receiving element, becomes larger as compared with the conventional device. In this case, if the constant voltage Vo is subtracted from the output voltage obtained by the conventional device, the relative sensitivity may become higher. However, since the multiple reflection inside the transparent electrode is not uniform, the error is always included in the measured result and thus the toner concentration cannot be detected accurately.

Figure 7:
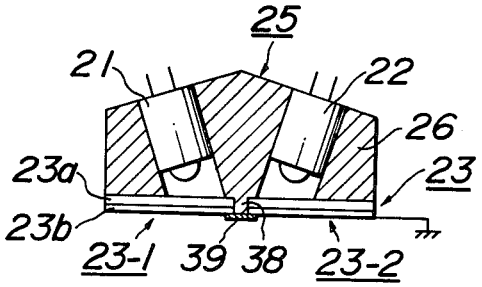

FIG. 7 is a schematic view showing the toner concentration detecting device 35 shown in FIG. 5. In this embodiment, on the lower surface of a housing 26 accommodating a light source 21 and a light receiving element 22 there is integrally formed a ridge 38 along a plane bisecting the light source and light receiving element. Then, transparent electrodes 23-1 and 23-2 are fixed to the housing 26 on both sides of the ridge 38, and further a metal strip 39 is secured to the outer surfaces of the ridge 38 and electrodes 23-1 and 23-2. In this manner the electrodes 23-1 and 23-2 are electrically connected to each other via the metal strip 39, but are separated optically from each other by means of the ridge 38.

In the embodiments shown in FIGS. 6 and 7, if the transparent electrode 23 is connected to the ground potential or a bias voltage source with the same polarity as that of the toner, either of the toner adhereds to the surface of the transparent electrode 23 and thus the output voltage derived from the light receiving element 22 can be kept uniform, so that it is possible to control the toner concentration accurately and uniformly. Moreover, in the case of effecting toner concentration control by using the toner concentration detecting device according to the invention, it is possible to control the toner concentration within a range of $\pm 0.5\%$ with respect to the predetermined concentration value of 7%, even after thirty thousand duplicating operations.

As clearly understood from the above, according to the invention, since the transparent plate is separated optically at the portion between the light source and the light receiving element, the multiply reflected light flux inside the transparent electrode can be blocked completely and thus the relative detection sensitivity of the toner concentration can be improved, so that it is possible to control the toner concentration accurately and uniformly.

Figure 9:
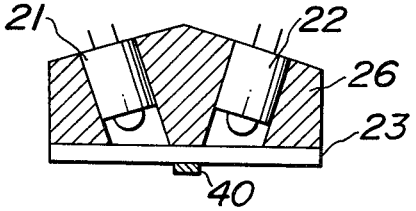
FIG. 9 is a schematic view showing another embodiment of a toner concentration detecting device according to the invention.

The present invention is not limited to the embodiments mentioned above, but various alterations and modifications are possible. As shown in FIG. 9, in order to interrupt the optical coupling between the light source 21 and light receiving element 20 by means of the transparent plate 23 without cutting the plate, it is possible to arrange a strip-shaped light absorption plate 40 at the portion between the light source and the light receiving element on the outer surface of the transparent plate 23. Moreover, it is apparent that the toner concentration detecting devices shown in FIGS. 6 and 7 can be preferably used with the developing devices shown in FIGS. 5 and 4, respectively. Further, in the embodiments mentioned above, the bias voltage is applied to the electrode consisting of the transparent plate made of, for example, glass, and the transparent conductive layer, but it is possible to use only the transparent plate and not to apply the bias voltage thereto.

What is claimed is:

1. In a toner concentration detecting device for detecting the toner concentration of a dry-type, two-component developer, said device comprising:

a housing, transparent plate-like means provided on said housing, means provided in said housing for projecting light toward the developer through the transparent plate-like means, means provided in said housing for receiving light scattered by the developer through the transparent plate-like means to produce a photoelectrically converted signal representing the toner concentration of the developer, and means for separating optically the portion of said transparent plate-like means located opposite said light projecting means from the remaining portion of said transparent plate-like means located opposite said light receiving means to eliminate multiple reflection inside said transparent plate-like means.

2. A toner concentration detecting device according to claim 1, wherein said transparent plate-like means is cut into two portions along a plane bisecting said light projecting means and said light receiving means, and said optical separating means comprises an opaque member interposed between said two portions.

3. A toner concentration detecting device according to claim 2, wherein said transparent plate-like means comprises a transparent plate and a transparent conductive layer, to which is applied a bias potential.

4. A toner concentration detecting device according to claim 3, wherein said opaque member comprises an opaque conductive adhesive.

5. A toner concentration detecting device according to claim 2, wherein said optical separating means comprises an opaque ridge formed integrally with said housing.

6. A toner concentration detecting device according to claim 5, wherein said transparent plate-like means comprises a transparent plate and a transparent conductive layer to which is applied a bias potential.

7. A toner concentration detecting device according to claim 6, further comprising a metal strip arranged on the ridge and both portions of the plate-like means to electrically connect the conductive layer portions to each other.

8. A toner concentration detecting device according to claim 1, wherein said transparent plate-like means comprises a single transparent plate and said optical separating means comprises a strip-shaped light absorption plate arranged on the outer surface of the transparent plate.

* * * * *